US010935028B2

(12) United States Patent
Helmis et al.

(10) Patent No.: US 10,935,028 B2
(45) Date of Patent: Mar. 2, 2021

(54) ELECTRIC FLUID PUMP FOR A MOTOR VEHICLE

(71) Applicant: PIERBURG PUMP TECHNOLOGY GMBH, Neuss (DE)

(72) Inventors: Martin Helmis, Neuss (DE); Thomas Wienecke, Willich (DE)

(73) Assignee: PIERBURG PUMP TECHNOLOGY GMBH, Neuss (DE)

( * ) Notice: Subject to any disclaimer, the term of this patent is extended or adjusted under 35 U.S.C. 154(b) by 167 days.

(21) Appl. No.: 16/310,819

(22) PCT Filed: Jun. 20, 2016

(86) PCT No.: PCT/EP2016/064201
§ 371 (c)(1),
(2) Date: Dec. 18, 2018

(87) PCT Pub. No.: WO2017/220119
PCT Pub. Date: Dec. 28, 2017

(65) Prior Publication Data

US 2020/0309136 A1 Oct. 1, 2020

(51) Int. Cl.
*F04D 13/06* (2006.01)
*F04D 29/58* (2006.01)
(Continued)

(52) U.S. Cl.
CPC ..... *F04D 13/0626* (2013.01); *F04D 29/5806* (2013.01); *F01P 2005/105* (2013.01);
(Continued)

(58) Field of Classification Search
CPC .. F04D 13/026; F04D 13/027; F04D 13/0633; F04D 13/0626; F04D 13/0686;
(Continued)

(56) References Cited

U.S. PATENT DOCUMENTS 5,785,013 A * 7/1998 Sinn ..... F04D 29/5813 123/41.44
6,036,456 A * 3/2000 Peters ..... F02M 25/0836 417/423.14
(Continued)

FOREIGN PATENT DOCUMENTS

CN 102242717 A 11/2011
CN 104179693 A 12/2014
(Continued)

*Primary Examiner* — Patrick Hamo
(74) *Attorney, Agent, or Firm* — Norman B. Thot

(57) ABSTRACT

An electric fluid pump for a motor vehicle includes a housing composite, a pump unit, a drive motor, a rotor shaft, and a motor controller which controls the drive motor. The housing composite defines a pump space, which includes a pump rotor space wherein a pump rotor of the pump unit is arranged, and a motor space wherein the drive motor is arranged, which together comprise a common end wall. The drive motor includes a motor stator, a motor coil arrangement, and a motor rotor. The rotor shaft co-rotatably connected to the motor rotor, and is arranged through the common end wall to rotate jointly with the pump rotor. The common end wall is a mounting wall part on which at least the motor controller is arranged. The motor coil arrangement is arranged on the motor stator and is provided on a side which is opposite to the motor controller.

14 Claims, 3 Drawing Sheets

(51) Int. Cl.
*F01P 5/10* (2006.01)
*F01P 5/12* (2006.01)

(52) U.S. Cl.
CPC .... *F01P 2005/125* (2013.01); *F04D 13/0633* (2013.01); *F04D 13/0686* (2013.01)

(58) Field of Classification Search
CPC ..... F04D 29/5806; F01P 2005/105; F01P 2005/125
See application file for complete search history.

(56) References Cited

U.S. PATENT DOCUMENTS 6,118,198 A * 9/2000 Hollenbeck ..... F04D 29/601 310/216.082
6,293,769 B1 * 9/2001 Radermacher ..... F04D 29/061 417/357
6,923,203 B2 * 8/2005 Wark ..... F16K 1/12 110/101 C
7,101,158 B2 * 9/2006 Hembree ..... F04D 13/025 417/420
9,458,757 B2 * 10/2016 Schreckenberg ..... F04D 29/628
2006/0057006 A1 * 3/2006 Williams ..... F04D 13/0633 417/423.14
2011/0254410 A1 10/2011 Wakabayashi et al.
2013/0136630 A1 5/2013 Eguchi

FOREIGN PATENT DOCUMENTS

DE 199 43 577 A1 3/2001
DE 199 43 862 A1 3/2001
DE 101 03 209 A1 7/2002
EP 1 085 213 B1 11/2004
EP 2 796 722 A1 10/2014
JP 2006-191718 A 7/2006
JP 2011-226352 A 11/2011
JP 2012-223063 A 11/2012
JP 2013-106421 A 5/2013
WO WO 2014/210093 A1 12/2014

* cited by examiner

ELECTRIC FLUID PUMP FOR A MOTOR VEHICLE

CROSS REFERENCE TO PRIOR APPLICATIONS

This application is a U.S. National Phase application under 35 U.S.C. § 371 of International Application No. PCT/EP2016/064201, filed on Jun. 20, 2016. The International Application was published in German on Dec. 28, 2017 as WO 2017/220119 A1 under PCT Article 21(2).

FIELD

The present invention relates to an electric fluid pump for a motor vehicle, comprising a housing composite, which defines at least a pump space and a motor space, wherein the pump space has a pump rotor space for a pump unit having a pump rotor and wherein a drive motor having a motor stator having a motor coil arrangement and a motor rotor is provided in the motor space, wherein the pump space and the motor space have a common end wall, wherein the motor rotor is connected to a rotor shaft for conjoint rotation, which rotor shaft is fed through the common end wall and on which rotor shaft the pump rotor is arranged for conjoint rotation, and wherein a motor controller is provided for controlling the drive motor.

BACKGROUND

A fluid pump for a motor vehicle serves to pump a fluid in a fluid circuit. It is known to pump a liquid heat transfer medium, hereinafter consistently referred to as a "coolant", into a heating or coolant circuit. The coolant circuit need not necessarily be a main flow of the circuit, but may also form an auxiliary flow. The purpose of such a coolant circuit is, however, to essentially cool motor units in an operating state. Electrically driven coolant pumps have in particular been developed to adapt the pump capacity of such a coolant pump to the respective operating state. An electronically commutated drive motor here drives a pump unit. A basic problem of such electronically commutated drive motors is the cooling of the drive motor and of the motor control which comprises a plurality of power semiconductors for controlling the motor coil arrangement, which may heat up strongly in operation and must be correspondingly cooled to prevent their destruction. The motor coil arrangement in this case is a heat source which should be thermally shielded with respect to the motor control or which should additionally be cooled if possible. It is thus known from the prior art that the coolant to be pumped is used to flow through the motor space so as to thereby cool a motor control space in which the motor control is provided. An example for an electric coolant pump of such design is described in EP 2 796 722 A1.

A major disadvantage of this known pump design is the relatively large pump space this pump requires, as well as the complicated channeling of liquids for cooling. In the context of an ever decreasing available installation space, the accommodation and mounting of such a pump at desired mounting sites can no longer be realized or can only be realized with difficulty. It should be clear that these disadvantages can also occur with electrically operated oil pumps, as well as with, for example, compressors or blowers.

SUMMARY

An aspect of the present invention is to avoid the above mentioned disadvantages in a simple and economic manner.

In an embodiment, the present invention provides an electric fluid pump for a motor vehicle which includes a housing composite, a pump unit, a drive motor, a rotor shaft, and a motor controller. The housing composite is configured to define at least a pump space and a motor space. The pump space comprises a pump rotor space. The pump space and the motor space comprise a common end wall. The pump unit comprises a pump rotor arranged in the pump rotor space. The drive motor is arranged in the motor space. The drive motor comprises a motor stator, a motor coil arrangement, and a motor rotor. The motor coil arrangement is arranged on the motor stator. The rotor shaft is connected to the motor rotor so as to jointly rotate with the motor rotor. The rotor shaft is arranged through the common end wall so as to jointly rotate with the pump rotor. The motor controller is configured to control the drive motor. The common end wall is provided as a mounting wall part on which at least the motor controller is arranged in a thermally conductive manner. The drive motor is provided as an asymmetrically permanently excited drive motor. The motor coil arrangement which is arranged on the motor stator is provided on a side which, in relation to the rotor shaft, is opposite to the motor controller.

BRIEF DESCRIPTION OF THE DRAWINGS

The present invention is described in greater detail below on the basis of embodiments and of the drawings in which.

DETAILED DESCRIPTION

Figure 1:
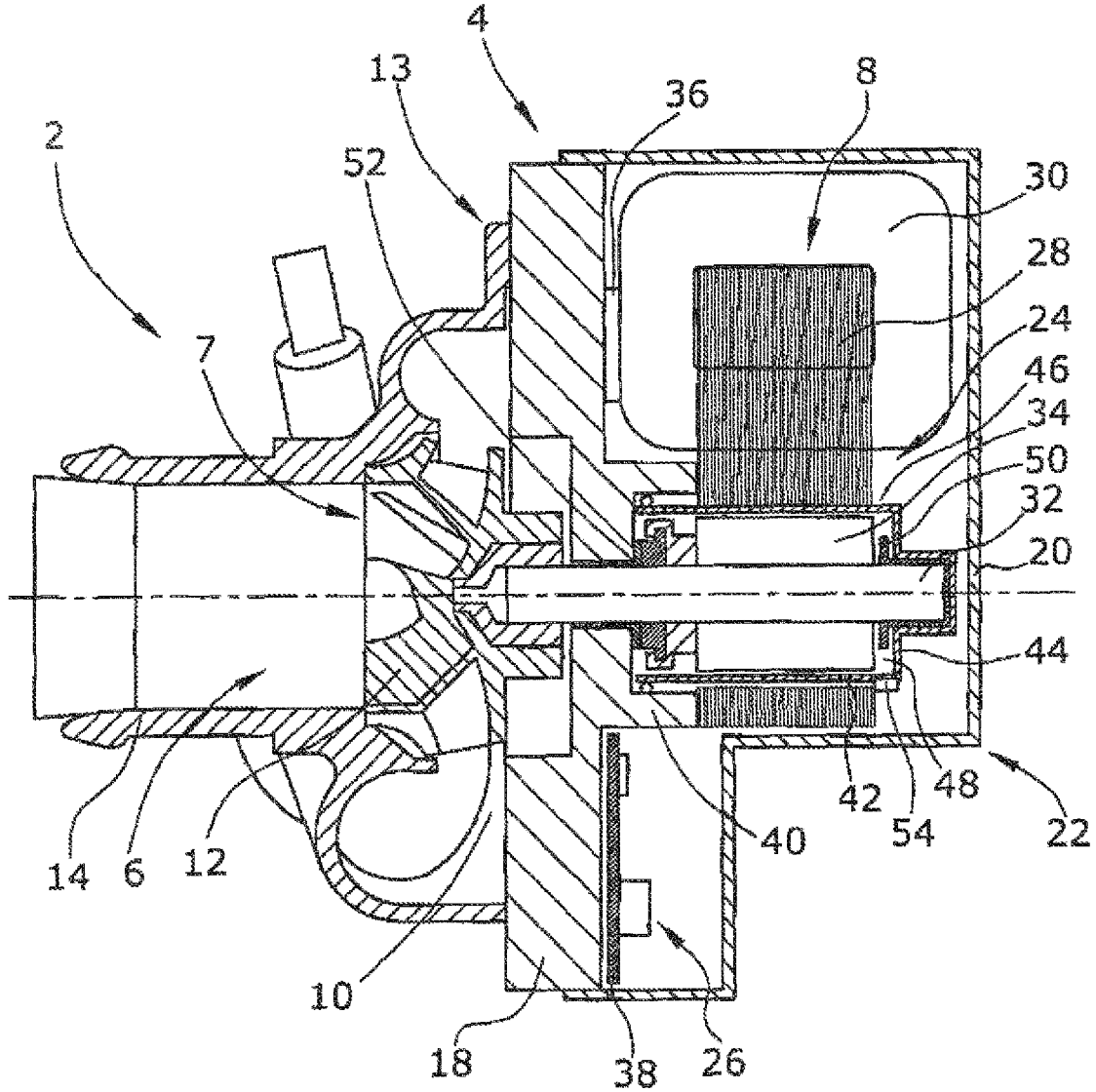
FIG. 1 is a sectional side view of a fluid pump according to the present invention.

The present invention forms the common end wall as a mounting wall part on which at least the motor control is arranged in a thermally conductive manner, wherein the drive motor is a 1-phase asymmetrically permanently excited drive motor, wherein the motor coil arrangement arranged on the motor stator is provided on a side which, in relation to the rotor shaft, is opposite the motor controller. With such a design, a closed motor control space is no longer required and additional space for the motor control is provided in the motor space, whereby a significant reduction in length and thus a saving of installation space is achieved. It is also possible to realize a saving of components. The channeling of liquid for cooling the drive motor and the motor control is also substantially simplified. A particularly space-saving drive motor is provided by designing the drive motor as a 1-phase asymmetric drive motor.

In an embodiment of the present invention, the motor control can, for example, be arranged on the mounting wall part via a large-surface plate element, in particular a circuit board, of a thermally conductive material. It is thus possible to provide an optimal heat transfer from the motor control into the mounting wall part cooled by the cooling fluid.

In an embodiment of the present invention, a cover element can, for example, be fastened on the mounting wall part as a part of the motor housing to thereby form a closed motor housing. It is also, however, possible to arrange the motor in an open state in the motor vehicle. If a cover element is provided, the motor stator and/or the motor coil arrangement may be arranged on the cover element which may offer advantages during assembly.

It is also advantageous in terms of heat dissipation if the motor stator and/or the motor coil arrangement are arranged on the mounting part via a thermally conductive material, such as, for example, a gap pad or a potting material. The rotor shaft may also be supported in the mounting wall part via a bearing.

The mounting wall part can advantageously comprise at least one shoulder element extending axially parallel to the rotor shaft, on which element the motor stator is fastened via a fastening device. This provides a particularly compact arrangement, wherein a coaxiality of the rotor shaft and thus of the motor rotor with respect to the motor rotor is achieved.

A bearing member for a can can advantageously be provided, on which bearing member the can is supported in a sealing manner so that a motor rotor space is created as a fluid-conducting space. A can end element may be provided in a sealing manner on the can and/or the motor stator. The can end element may, however, also be an integral part of the can. Further bearing(s) for the rotor shaft may then be provided in the can end element.

A contactless sensor, in particular a Hall sensor, can advantageously be provided in the region of the motor rotor, in particular in the region of the outer side of the can or is integrated therein.

The present invention will be explained in detail below under reference to the drawings.

Figure 2:
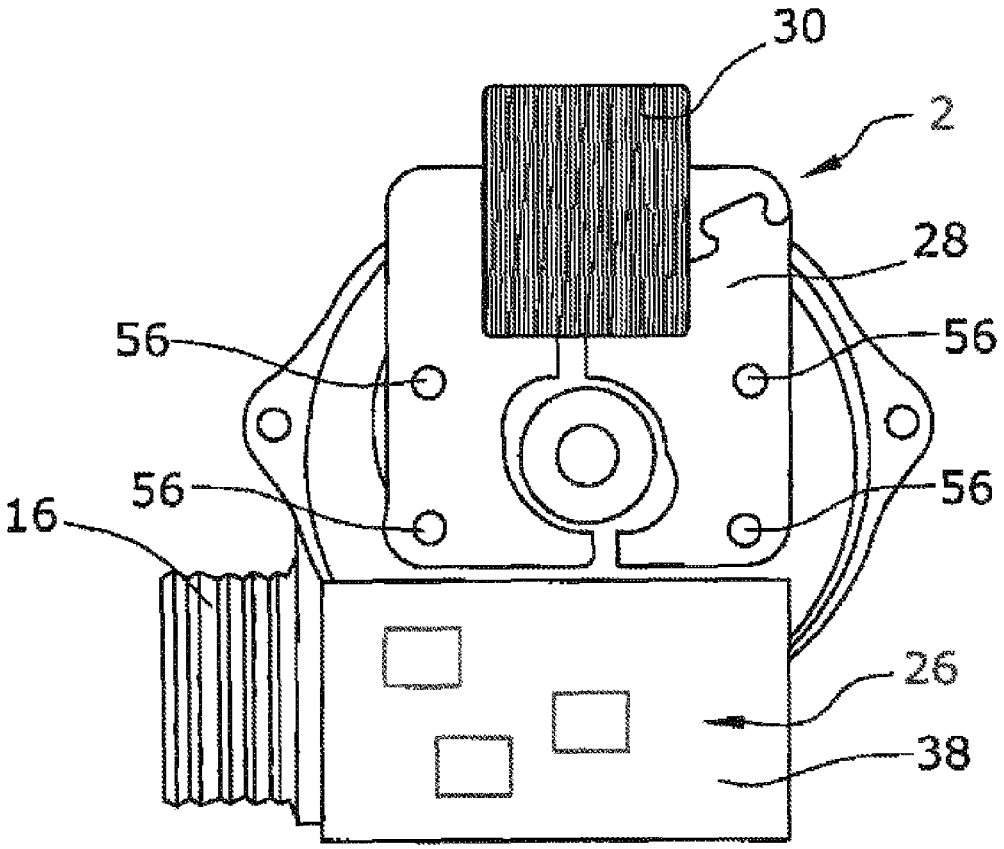
FIG. 2 is a sectional end view of the electric fluid pump in FIG. 1.

FIG. 1 shows a sectional side view of an electric fluid pump 2 of the present invention designed as a coolant pump for a motor vehicle (which is not illustrated in detail). It should be clear that the present invention is not restricted to such a coolant pump. All electric pumps and blowers much rather fall within the scope of the present invention. The electric fluid pump 2 comprises a housing composite 4 that defines a pump space 6 for a pump unit 7 and a motor space 8. In a manner known per se, the pump space 6 comprises a pump rotor space 10 in which a pump rotor 12 is provided and which, in the present embodiment, is formed by a pump housing 13. In a manner known per se, the pump housing 13 has an inlet 14 and an outlet 16 which is shown in FIG. 2. The pump space 6 and the motor space 8 are delimited by a common end wall 18. In the present embodiment, a cover element 20 is provided fastened to the common end wall 18 and thus forming a motor housing 22 with a closed motor space 8 in which a drive motor 24 and a motor controller 26 are provided. It is also conceivable, however, to omit the cover element 20 and to thereby form a motor space 8 which is open.

The drive motor 24 is designed as an asymmetrically permanently excited drive motor, wherein a motor coil arrangement 30 arranged on a motor stator 28 is provided on a side averted from the motor control 26 with respect to a rotor shaft 32. A motor rotor 34 is arranged on the rotor shaft 32 for conjoint rotation in a manner known per se. The pump rotor 12 is also mounted on the rotor shaft 12 for conjoint rotation. In a manner known per se, the motor stator 28 is here designed as a bundle of laminations.

According to the present invention, it is provided that the common end wall is formed as a mounting wall part on which, in the present embodiment, the motor control 26 and the motor stator 28 are arranged. The motor coil arrangement 30 in this case abuts the mounting wall part 18 via a potting material 36 and can thus be cooled in a simple manner. The motor control 26 is provided on a large-surface thin circuit board 38 which is in turn mounted on the mounting wall part 18. Due to the large-surface thin circuit board 38, an optimal heat transfer occurs from the motor control 26 to the mounting wall part 18 cooled by the cooling fluid.

The mounting wall part 18 further comprises a bearing member 40, a can 42 with an integrated can end element 44 being sealingly supported on the inner side of the member via a seal 46. An additional motor space 48 thus defined is accordingly adapted for the throughflow of cooling fluid.

Figure 3:
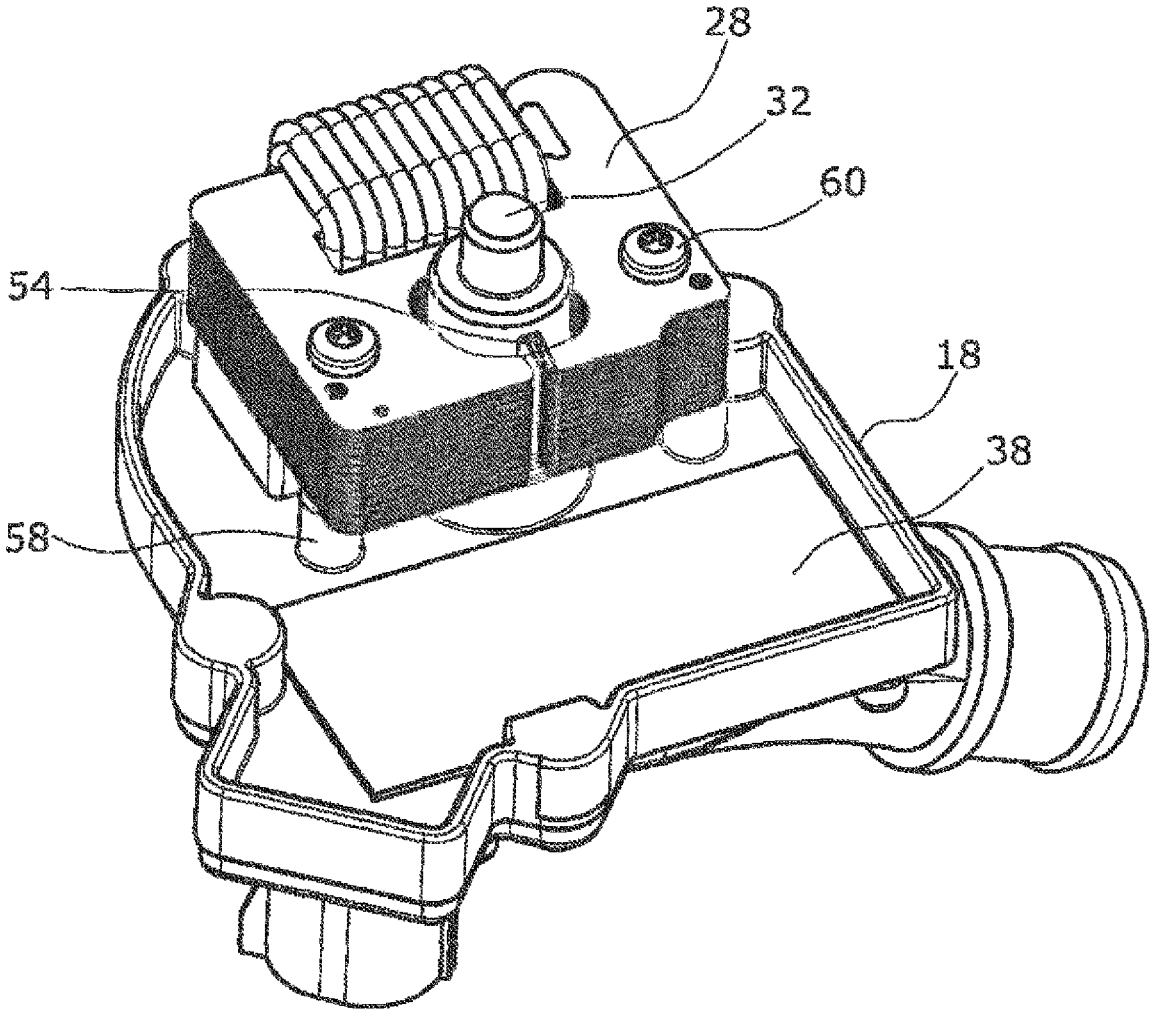
FIG. 3 is a perspective view of a motor space of a mounting wall part of the fluid pump of the present invention.

The motor stator 28 configured as a stator package is arranged on the mounting wall part 18 on axially parallel shoulder elements 58 via screws 60 (see FIG. 3).

The rotor shaft 32 extending through the mounting wall part 18 is supported in the can end element 44 and in the mounting wall part 18 via a suitable bearing 50, 52. Illustrated only schematically in FIG. 2 and in more detail in FIG. 3 is a contactless sensor 54 designed as a Hall sensor which, in a manner known per se, monitors a rotary position of the drive motor 24 and which, integrated in the can 42, is arranged in the region of a pole gap of the motor stator 28.

FIG. 2 shows the electrical fluid pump 2 of FIG. 1 in a sectional end view. The motor stator 28 designed as a stator package is clearly discernible, the stator having openings 56 through which the screws 60 illustrated in FIG. 3 can be passed to fasten the stator package 28 to the cylindrical shoulder elements 58 of the mounting wall part 18. As can be seen clearly, the motor stator 28 has a rectangular stator geometry whereby a reduction of the sheet production costs is possible. The arrangement of the present invention allows for a simplification of the electronics and for a simple processor due to the use of the Hall sensor 54.

The present invention is not limited to embodiments described herein; reference should be had to the appended claims.

What is claimed is:

1. An electric fluid pump for a motor vehicle, the electric fluid pump comprising:

a housing composite comprising a cover element, the housing composite being configured to define at least a pump space and a motor space, the pump space comprising a pump rotor space, the pump space and the motor space comprise a common end wall;

a pump unit comprising a pump rotor arranged in the pump rotor space;

a drive motor arranged in the motor space, the drive motor comprising a motor stator, a motor coil arrangement and a motor rotor, the motor coil arrangement being arranged on the motor stator;

a rotor shaft connected to the motor rotor so as to jointly rotate with the motor rotor, the rotor shaft being arranged through the common end wall so as to jointly rotate with the pump rotor; and a motor controller configured to control the drive motor, wherein, the common end wall is provided as a mounting wall part on which at least the motor controller is arranged in a thermally conductive manner, the cover element of the housing composite is fastened on the mounting wall part, the drive motor is provided as an asymmetrically permanently excited drive motor, the motor coil arrangement arranged on the motor stator is provided on a side which, in relation to the rotor shaft, is radially opposite to the motor controller, the motor coil arrangement is arranged on the common end wall, and the motor stator is arranged on the cover element.

2. The electric fluid pump as recited in claim 1, further comprising:

a large-surface plate element which is comprised of a thermally conductive material, wherein, the motor controller is arranged on the mounting wall part via the large-surface plate element.

3. The electric fluid pump as recited in claim 2, wherein the large-surface plate element is a circuit board.

4. The electric fluid pump as recited in claim 1, wherein the motor coil arrangement is arranged on the cover element.

5. The electric fluid pump as recited in claim 1, wherein at least one of the motor stator and the motor coil arrangement is/are arranged on the common end wall which is provided as the mounting wall part via a thermally conductive material.

6. The electric fluid pump as recited in claim 5, wherein the thermally conductive material is a gap pad or a potting material.

7. The electric fluid pump as recited in claim 1, further comprising:

a bearing, wherein, the rotor shaft is supported in the common end wall which is provided as the mounting wall part via the bearing.

8. The electric fluid pump as recited in claim 1, further comprising:

a fastening device, wherein, the common end wall which is provided as the mounting wall part comprises at least one shoulder element which is arranged to extend axially parallel to the rotor shaft, on which at least one shoulder element the motor stator is fastened via the fastening device.

9. The electric fluid pump as recited in claim 1, further comprising:

a can; and a bearing member which is configured to support the can in a sealing manner.

10. The electric fluid pump as recited in claim 9, further comprising:

a pot end element arranged on at least one of the can and the motor stator in a sealing manner.

11. The electric fluid pump as recited in claim 10, further comprising:

a bearing for the rotor shaft which is arranged in the pot end element.

12. The electric fluid pump as recited in claim 9, further comprising:

a contactless sensor arranged in a region of the motor rotor.

13. The electric fluid pump as recited in claim 12, wherein the contactless sensor is further arranged in a region of an outer side of the can or is integrated in the can.

14. The electric fluid pump as recited in claim 12, wherein the contactless sensor is a Hall sensor.

* * * * *